US006644086B1

(12) United States Patent
Bodnar

(10) Patent No.: US 6,644,086 B1
(45) Date of Patent: Nov. 11, 2003

(54) RETRO-FIT ROLL FORMING MILL WITH JACK SCREW

(75) Inventor: Ernest R. Bodnar, North York (CA)

(73) Assignee: Formtek, Inc., Westfield, MA (US)

( * ) Notice: Subject to any disclaimer, the term of this patent is extended or adjusted under 35 U.S.C. 154(b) by 0 days.

(21) Appl. No.: 10/146,507

(22) Filed: May 14, 2002

(51) Int. Cl.[7] ..... B21D 5/08
(52) U.S. Cl. ..... 72/181; 72/247
(58) Field of Search ..... 72/164, 179, 180, 72/181, 247, 248

(56) References Cited

U.S. PATENT DOCUMENTS

| | | | | |
|---|---|---|---|---|
| 1,125,984 | A | 1/1915 | Dumas | |
| 3,348,403 | A | 10/1967 | Bartley | |
| 3,595,056 | A | 7/1971 | Hutton | |
| 3,886,779 | A | 6/1975 | McClain | |
| 3,914,971 | A | 10/1975 | Colbath | |
| 4,471,641 | A | 9/1984 | Mitchell | |
| 5,163,311 | A | 11/1992 | McClain et al. | |
| 5,319,952 | A | 6/1994 | Cadney | |
| 5,787,748 | A | 8/1998 | Knudson et al. | |
| 5,829,294 | A | 11/1998 | Bradbury et al. | |
| 6,282,932 | B1 * | 9/2001 | Surina et al. | 72/7.6 |
| 6,289,708 | B1 * | 9/2001 | Keinanen | 72/178 |
| 6,434,994 | B2 * | 8/2002 | Bradbury et al. | 72/178 |

* cited by examiner

*Primary Examiner*—Ed Tolan
(74) *Attorney, Agent, or Firm*—McCormick, Paulding & Huber LLP

(57) ABSTRACT

A rolling mill apparatus for forming a web of material includes a die stand having an upper die assembly and a lower die assembly, the die stand bending the web to a predetermined formation angle as the web passes between the upper die assembly and the lower die assembly. A movement apparatus is utilized for selectively moving the upper die assembly in a vertical direction, thereby adjusting a vertical clearance between the upper die assembly and the lower die assembly. A pin is fixed to the upper die assembly and a cam block having a groove formed at a predetermined orientation angle is also provided. The pin travels in the angled groove when the upper die assembly is moved in the vertical direction and causes the upper die assembly to move horizontally. The predetermined orientation angle of the block is approximately equal to the predetermined formation angle.

18 Claims, 13 Drawing Sheets

RETRO-FIT ROLL FORMING MILL WITH JACK SCREW

FIELD OF THE INVENTION

The present invention relates in general to a roll forming mill, and more particularly to a roll forming mill capable of uniformly adjusting both the horizontal and the vertical separations between matching upper and lower roller dies.

BACKGROUND OF THE INVENTION

Roll forming machinery usually has a plurality of sets of rolls, usually arranged in upper and lower pairs, and usually spaced apart along the length of the machine on roller die stands. Typically, the roller dies at one die stand will produce a continuous formation in the web, and the roller dies of the next die stand will produce another formation, or for example increase the angle of the formation which has already been started at the previous die stand and so on.

A wide variety of commercial and other products are made on such roll forming machines, such as roof decking siding, and a large number of components for consumer equipment. The shapes may simply be webs with edge formations formed along one edge or both, or may be C sections or U sections but in many cases consist of relatively complex formations with longitudinal formations being formed along the length of the web, side by side.

Generally speaking at each die stand of rolls there are two lower dies and two upper dies arranged in pairs, to form the web on either side of a central web axis. The lower dies engage the underside of the web and the upper dies engage the upper side of the web. The dies have circular shapes, and are mounted on rotatable axles so that the dies can rotate at the same speed as the sheet metal.

A gear drive mechanism is coupled to the dies so as to drive them at the speed of the sheet metal.

Each set of such roller dies must be designed to provide a particular formation in the web. In addition, each pair of dies must have a clearance between them determined by the thickness of the web.

Thus where it is desired to discontinue working on a web of one thickness, and to then run a web of another thickness through the dies, each pair of roller dies must be readjusted to a new clearance, to accommodate the new thickness of the new web. This involves costly down time, in order to make the fine adjustments.

Generally speaking, it is not possible to adjust the clearances of the roller dies during the actual operation of the machine, and the best that can be done is that in the initial set up for any particular run, the machinist will set the die clearances to a predetermined average web thickness. The results obtained in this way however are not always entirely satisfactory.

It would in theory, be desirable to provide for automatic self-adjustment of the spacings or clearances between the pairs of dies in each die stand. However, due to the shaping of the dies there are difficulties in such adjustments. Usually the dies will have two surfaces, one of the surfaces being more or less horizontal, or at least parallel to the plane of the web itself, and the other of the surfaces being at a web-forming angle.

Another set of problems arises if it is desired to use the same roller dies, to form a web having a width which is greater, or narrower than a preceding web.

In the past each of the die stands would have to be manually moved further apart, or closer together, to take in to account the width of the new web to be processed. However, it was time consuming to dismantle the arrangement of dies for one web width, and then reassemble the dies with a greater or lesser umber of rolls between them to suit the new web width. In addition, this was awkward and time-consuming manual work.

It is therefore desirable to provide for roller die stands arranged- in pairs, in which one of each of the die stands in each of the pairs shall be transversely moveable relative to the other.

Given both die clearance adjustment, and die stand width adjustment, it would be possible, using one set of roller die stands and dies, to provide for the processing of webs both of different thicknesses, and also of different widths. This enables a manufacturer to produce a standard rolled form section such as a "C" section in a variety of widths and in a variety of gauges, from a single machine. This would reduce the capital investment in machinery. In addition would reduce the down time required for change over from one web to another and also reduce the need for skilled labor.

Unfortunately, the cost of a new machine with the desirable features outlined above may not be within the reach for many companies. A way to circumvent this difficulty is to provide a modification or retro-fit kit to update existing Roll Forming Machines. This type of retro-fit would update the older machines with current technology and allow for motorized adjustment of the dies to accommodate for various thickness of a web. This would decrease the amount of downtime, the cost of manual labor and increase productivity of these older machines. Thus enabling them to remain competitive.

A further problem arises with roll forming certain sections, particularly sections which have the shape of a letter C with in turned flanges, or a partially closed-in box section.

In this type of section, the two edges or flanges of the C, or partially closed-in box, are turned inwardly. This is usually done by roll forming the edge flanges first, and then roll forming the C bends later, i.e., downstream. Special dies are required to form the last bends, and it is desirable to provide for adjustment of these dies. Adjustment of such dies in this location however, to accommodate variations in web thickness and to form different sizes of C-section presents further problems.

With the foregoing problems and concerns in mind, the present invention therefore seeks to provide for the efficient and simultaneous adjustment of a plurality of die stands, both in new roll forming mills as well as a retro-fit to older, existing roll forming mills.

SUMMARY OF THE INVENTION

According to one embodiment of the present invention, a rolling mill apparatus for forming a web of material includes a die stand having an upper die assembly and a lower die assembly, the die stand bending the web to a predetermined formation angle as the web passes between the upper die assembly and the lower die assembly. A movement apparatus is utilized for selectively moving the upper die assembly in a vertical direction, thereby adjusting a vertical clearance between the upper die assembly and the lower die assembly. A pin is fixed to the upper die assembly and a cam block having a groove formed at a predetermined orientation angle is also provided. The pin travels in the angled groove when the upper die assembly is moved in the vertical direction and causes the upper die assembly to move horizontally. The predetermined orientation angle of the block is approximately equal to the predetermined formation angle.

These and other objectives of the present invention, and preferred embodiments thereof, shall become clear by consideration of the specification, claims and drawings taken as a whole.

BRIEF DESCRIPTION OF THE DRAWINGS

FIG. 5*a* is a section of a portion of the outboard die stand showing the slide mechanisms for sliding the bearing block.

DETAILED DESCRIPTION OF THE PREFERRED EMBODIMENT

Figure 1:
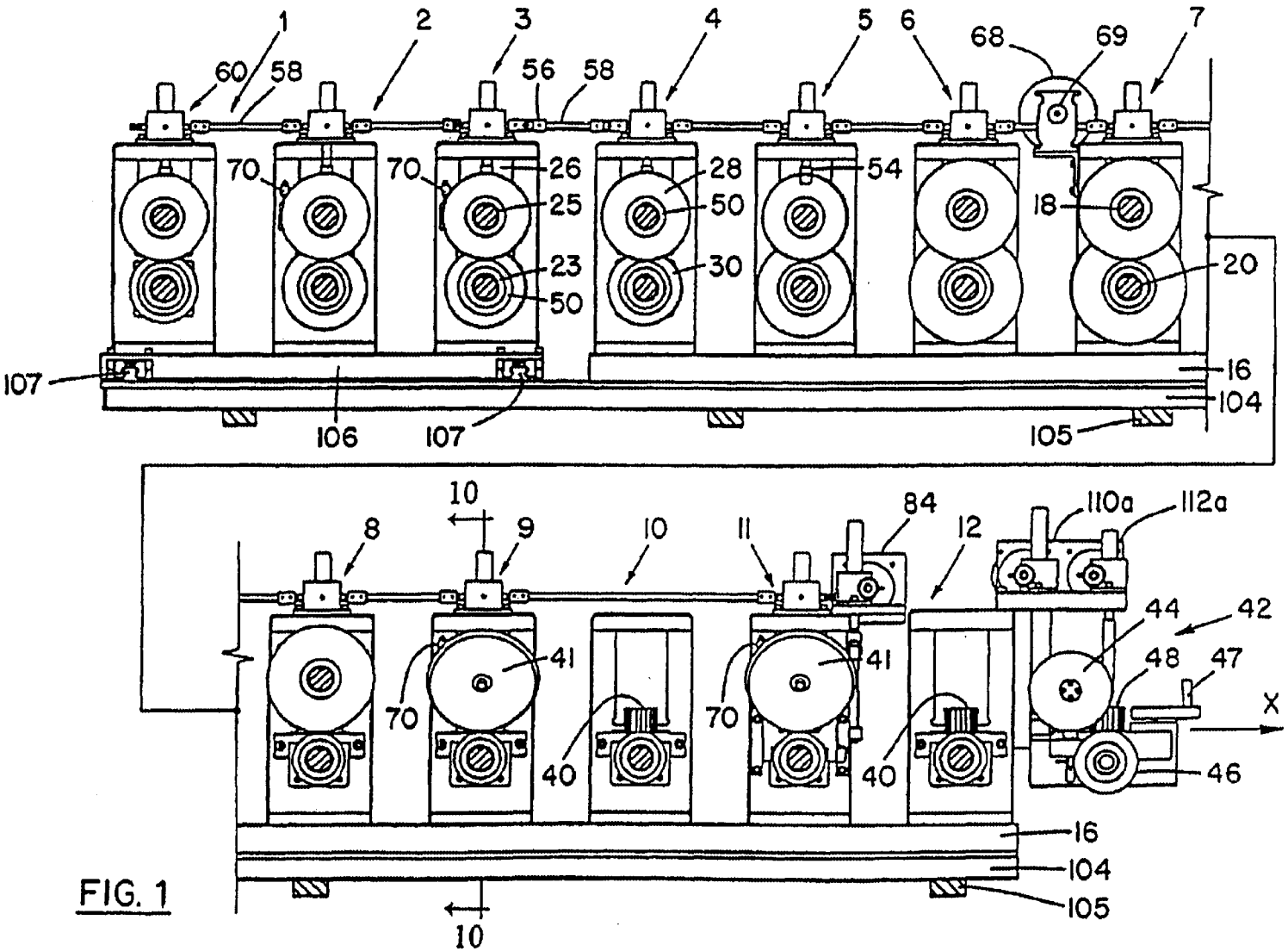
FIG. 1 is a side view of the outboard retro-fit roll-forming apparatus, from the inboard side.
Figure 2:
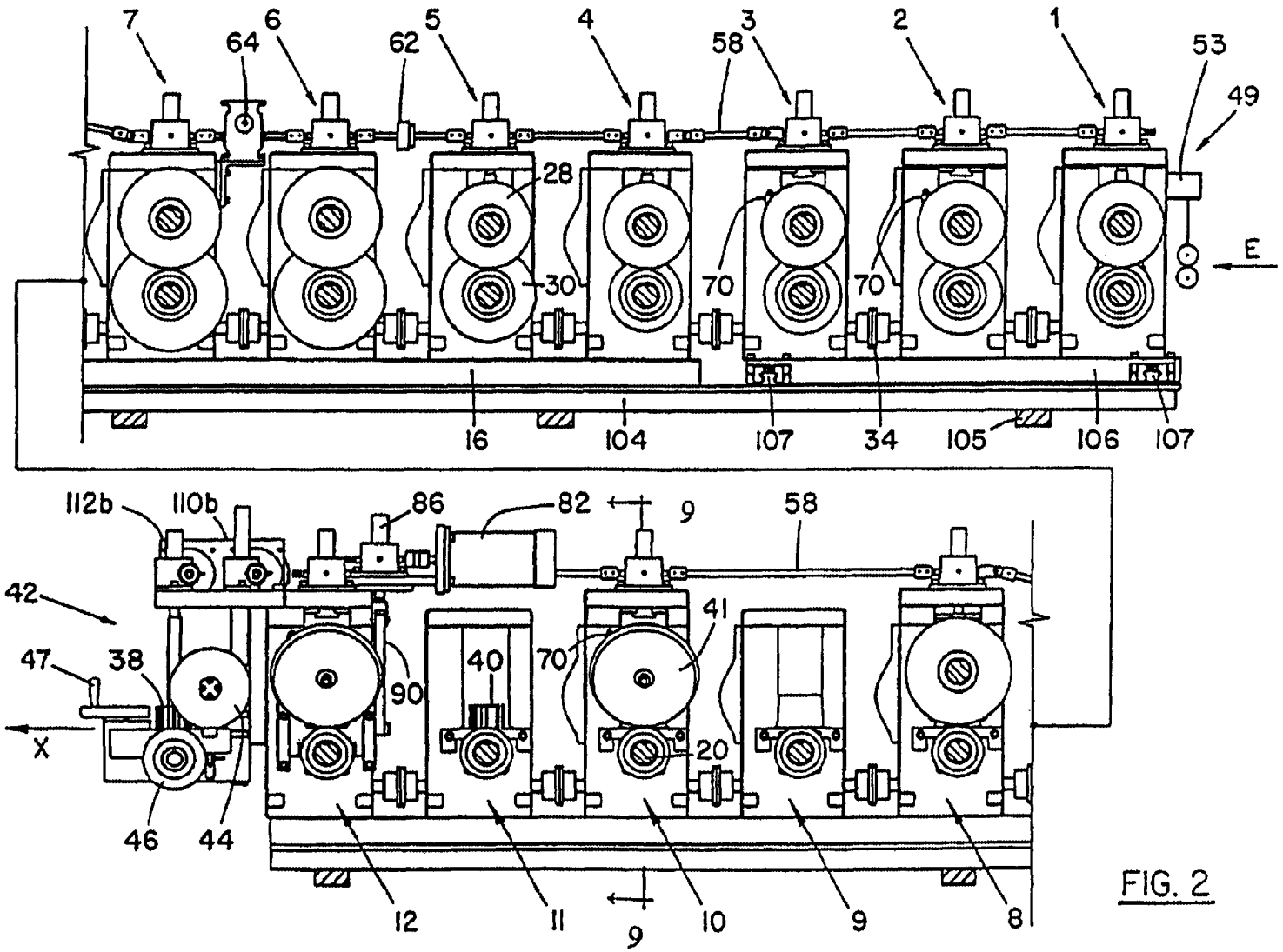
FIG. 2 is a side view of the inboard retro-fit roll-forming apparatus, from the outboard side.
Figure 3:
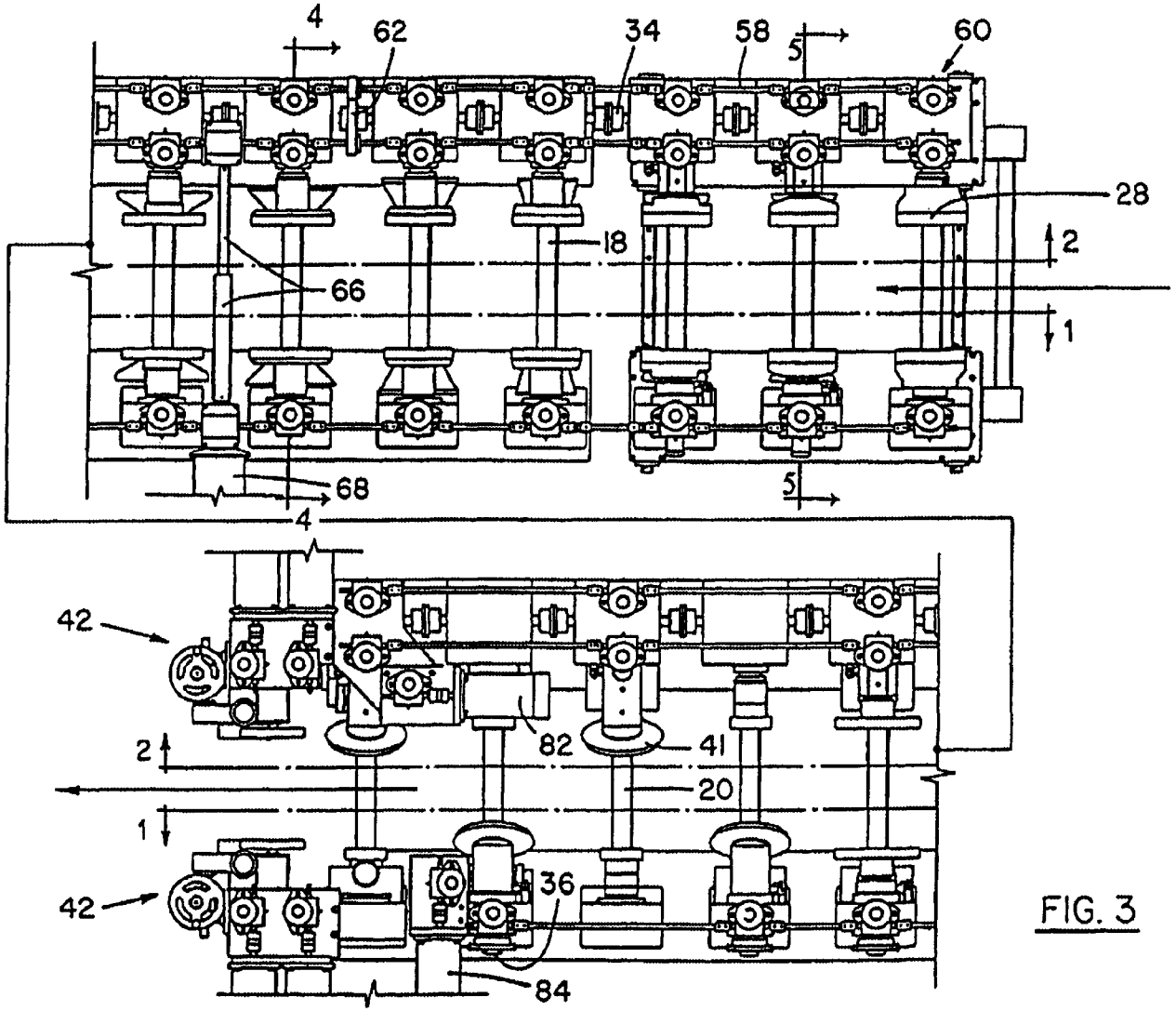
FIG. 3 is a top view of the retro-fit roll-forming apparatus.
Figure 4:
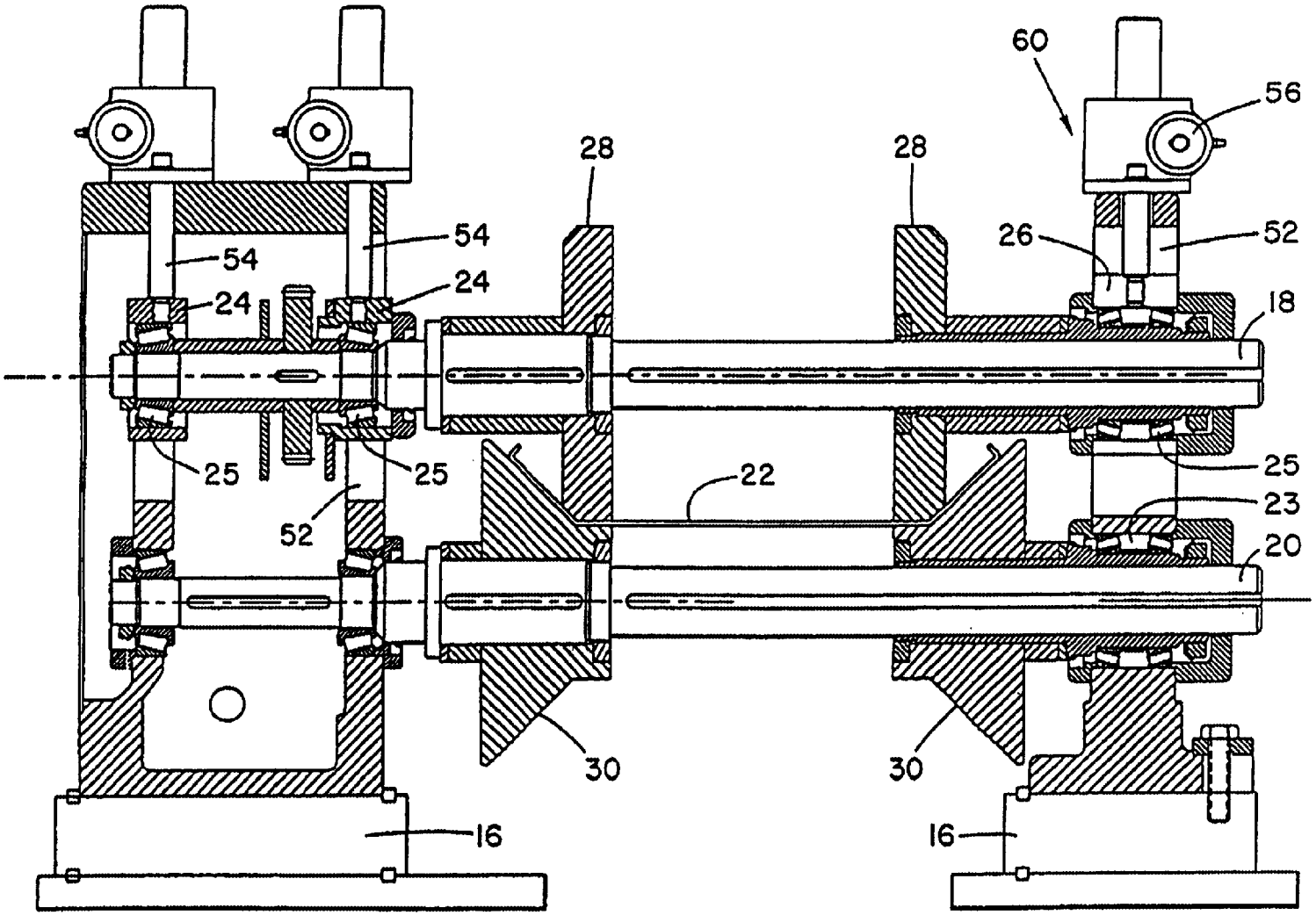
FIG. 4 is a cross-section of the retro-fit roll-forming apparatus at pass 6, along line 4—4 of FIG. 3.
Figure 5:
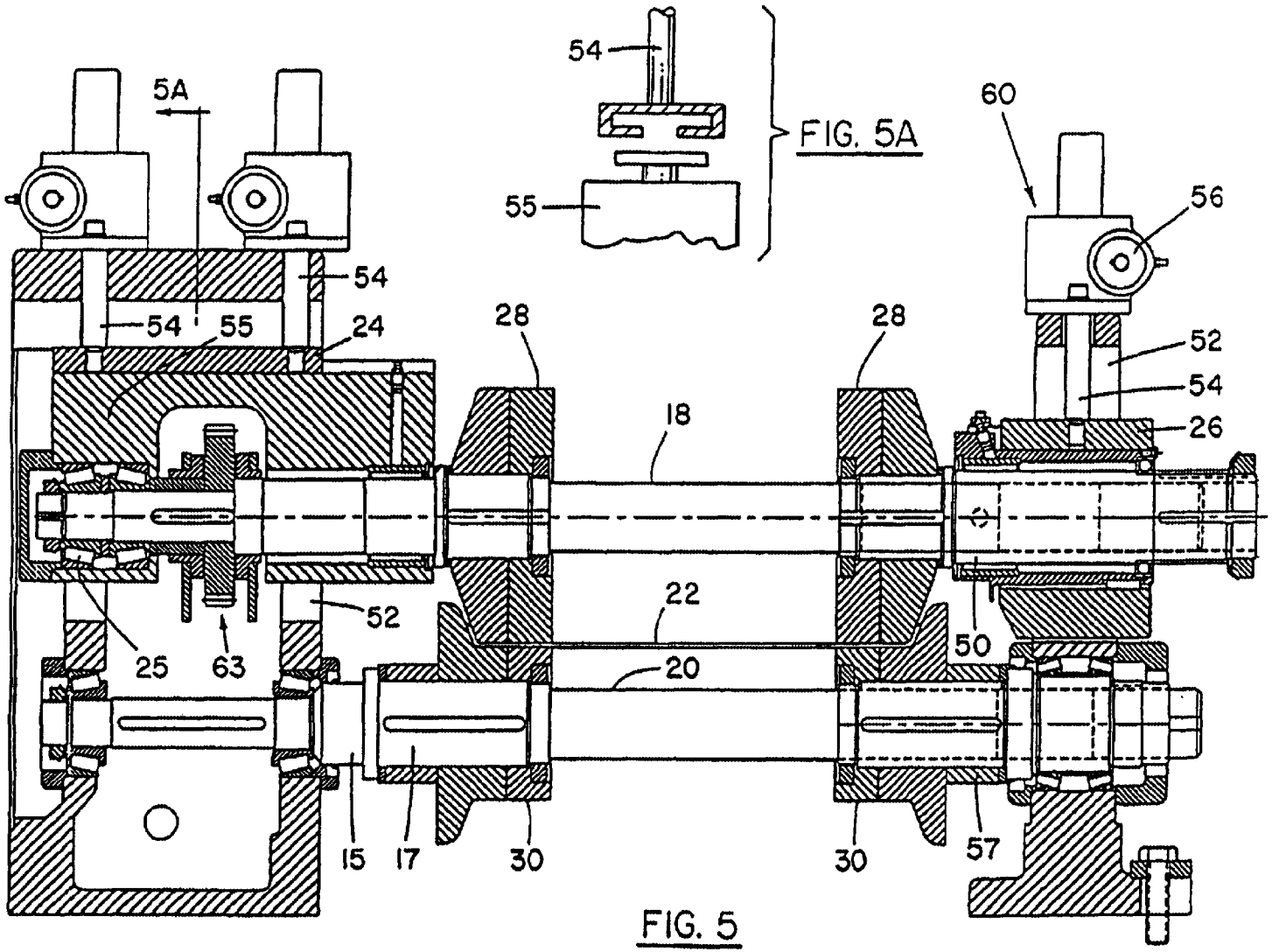
FIG. 5 is a cross-section of the retro-fit roll-forming apparatus at pass 2, along line 5—5 of FIG. 3.

Roll-Forming machines form metal strips into desired shapes. This is accomplished by passing the strip sheet metal through a plurality of roll forming dies, gear driven along the length of the machine. The sheet metal strip is continuously formed by passing through the plurality of roller dies, each roller die set, forming the sheet metal strip in succession until the final shape is achieved.

The invention is directed to retro-fitting and improving existing roller die apparatus's. The illustrations show a roll-forming apparatus (14) consisting of several pairs of die stands (OI1-12) along the length of the machine. These die stands (OI1-12) are secured to a base (16) in fixed spaced apart intervals, along the length of the machine. The pairs of outboard (O1–12) and inboard (I1-12) die stands support upper and lower rotatable transverse die axles (18, 20), and were originally designed to be manually adjustable horizontally, relative to each other. Such horizontal adjustments allow for web material (22) of different widths. Within the outboard and inboard die stands (OI1-12) there were lower and upper die axle support bearings (23, 25) for carrying the rotatable transverse die axles (18, 20). The upper and lower die axle support bearings (23, 25) were found within die bearing sleeves (50), located within upper inboard and outboard die axle supports (24, 26) and lower inboard and outboard opening (27). The upper die axle supports (24, 26) were manually adjustable vertically. Vertical adjustments were necessary to accommodate web material (22) of different thickness or dies of different profiles. Vertical adjustments were also necessary where the actual profile of the end product was being changed. The inboard and outboard upper die axle supports (24, 26), contain upper axle support bearings (25) which support the upper rotatable transverse die axle (18) between them. The upper rotatable transverse die axle (18) was mounted parallel in a vertical field to a lower rotatable transverse die axle (20) which was supported by a lower die axle support bearing (23) fixed-mounted directly within an opening (27) in the inboard and outboard die stands (OI1-12). The upper rotatable transverse die axle (18) and the lower rotatable transverse die axle (20), support matching circular roller dies (28, 30). The upper and lower roller dies (28, 30) are mounted on the upper and lower rotatable transverse axles (18, 20), respectively, and therefore rotate in direct relation to the rotational speed of the axles (18, 20). Generally there are two upper (28—28) and two lower roller dies (30—30) on their respective axles. The upper and lower circular roller die (28, 30) pairs are spaced apart a predetermined clearance according to the thickness or gauge of the web material (22) to be passed along the length of the machine. The web-material (22) passes through pairs of roller dies (28, 30), with the upper roller die (28) contacting the top surface of the web material (22) and the lower roller die (30) contacting the under side of the web material (22). As the web material (22) passes continuously along the length of the apparatus from the entrance (E) to the exit (X), each matched set of roller dies (28–30, 28–30) of each die stand contact the material and shape it according to the angle of the roller dies. Each successive set of roller dies (28, 30) usually increase the angle of the formation until, at the end of the machine length, the desired formation is achieved. This formation could be a C, U, Z, a variation thereof, or many other formations depending on the arrangement of the roller dies and the specific roller dies used in any given instance.

The lower rotatable transverse die axles (20) of the first set of die stands (OIl) were connected to a suitable motor (32) which drove a drive train (34) on the inboard side (I) and in turn connected to the upper rotatable transverse die axle (18) by a drive gear mechanism (36). Each successive set of upper and lower rotatable transverse axles (18, 20) are meshed together by drive gear mechanisms (36) which drive all the rotatable transverse axles (18, 20) in a unified direction from the entrance (E) to the exit (X). The upper rotatable transverse axle (18) and the lower rotatable transverse axle (20) rotate in opposite directions to each other. The upper rotatable transverse axle (18) rotates in a clockwise direction, while the lower rotatable transverse axle (20) rotates in a counterclockwise direction. This opposition in rotation, causes the web material (22) to move in one direction from right to left (as illustrated) along the length of the machine. The upper and lower roller dies are coupled to the rotatable transverse axles (18, 20) so as to drive the roller dies (28, 30) at the same speed as the web material (22).

This is all well known in the art as standard features of roll-forming machines (14).

In accordance with the present invention, motorized uniform die clearance adjustors may be retrofitted to the existing roll-forming machine. These will have two important results: 1) To eliminate the need for individual (01-12 inboard and outboard die stands) vertical and horizontal adjustment of the web gauge clearance between the upper and lower roller dies (28, 30) at the beginning of any particular run.

In accordance with the present invention, as explained above, there is provided means for adjusting at least one of the upper and the lower roller dies (28, 30) relative to the other, so as to adjust the clearance between the roller dies (28, 30), to match the thickness or gauge of the web material (22) as closely as possible. As generally described above, the adjustment of the roller die clearance is achieved by moving, in this embodiment, the upper roller die (28) relative to the lower roller die (30). In this embodiment the lower roller die (30) remains unadjusted. It should be noted that the lower roller dies could also be made to be adjustable in other embodiments, if deemed necessary.

The adjustment of the upper roller die (28) of at least some of the die stand pairs (OI1-12) preferably takes place in two planes, that is to say along the axial or horizontal direction of the rotatable transverse die axle (18), with the roller die moving together with the rotatable transverse die axle (18) in the axial direction, and secondly, the upper roller die (28) is moved on an axis transverse or vertical to the axial direction of rotatable transverse die axle (18), i.e. up and down.

By providing adjustments in both planes, the final clearance adjustment is made along a diagonal axis. However, on many of the die stand pairs (OI1-12), vertical adjustment by itself may be adequate.

Movement of the upper roller dies (28) horizontally and vertically are described below.

The roll forming machine must also be adjustable in width to allow for forming of wider or narrower pieces or products. The width adjustment is made at the beginning of a job, according to the material to be run. The adjustment of existing standard machines is done manually and involves costly down time. The retrofitted improvements enable the operator to adjust for width using a motor, thus drastically decreasing the length of downtime. This translates into increased productivity.

In the art of roll-forming machines (14), it is known that in order to form right angle side walls from strip metal pieces by roller forming dies (28, 30), the angles were forced past the desired angles to compensate for backlash or springback of the metal (i.e. the tendency of the metal to resist the formed angle and return to a more relaxed state). In older machines, the method used to force the walls to desired angles, utilized threaded elevating screw and nut systems that were manually adjusted and set at the beginning of the job. This had to be done precisely by a knowledgeable operator. Imprecise adjustment could cause deformities in the finished product, dictating readjustment and further downtime.

In accordance with this invention, the retrofitted improvements replace these threaded elevating screw and nut systems with pivoting and non-pivoting side roll and diagonal corner roll assemblies (38, 40, 41) which are controlled by a computer (C) and are automatically adjustable. This, therefore, eliminating the need of manual adjustment and possible human error in precision. The methods of control and adjustment are discussed below.

The retro-fit system also includes a warp control addition. This warp control assembly (42) is located at the exit (X) of the roll-forming machine (14) and can be either operated manually or motorized. As the product moves along the length of the machine, through the roller dies (OI1-12), slight warping or twisting may occur. The warp control assembly (42), utilizing an upper and lower straightening roller (44, 46) and a straightening side roller (48), will adjust accordingly to straighten the finished piece. This will be discussed in greater detail below.

Adjustment of Die Clearance

As explained, the lower roller die (30) remains unadjusted. It simply rotates along with its rotational transverse die axle (20), which runs in die axle support bearings (23) within the die bearing sleeve (57), mounted directly in inboard and outboard die stands (OI1-12).

Vertical Die Adjustment

The two upper roller dies (28—28) located on the upper rotatable transverse die axles (18) of each set of inboard and outboard die stands (OI1-12) are mounted in upper axle support bearings (25). In the case of inboard die stands; 1, 4, 5, 6, 7 and outboard die stands; 1, 2, 3, 4, 5, 6, 7, 8 (in this illustration) the upper axle support bearings (25) are in turn mounted within upper slidable bearing sleeves (50). Inboard die stands 2, 3, 8, 10, 12 and outboard die stands 9,11, have upper die axle support bearings (25) mounted in slidable blocks (55). The bearing sleeves (50) and slidable blocks (55) are mounted in upper die axle supports (24, 26) which are received in openings (52) in the inboard and outboard stands (OI1-12). The vertical up-down movement of the upper roller dies (28–28) is accomplished by up-down displacement of the upper die axle supports (24, 26) using jack screws (54). The jack screws (54) extend through openings in respective outboard and inboard die stands (OI1 12) and are terminally secured to the upper die axle supports (24, 26). The jack screws (54) are connected by bevel gears (56) to connecting rods (58). The jack crew assemblies (60) are linked together by connecting rods (58) in a suitable manner so as to provide adjustment in a unified manner along the length of the machine.

The outboard stands (O1–12) of the machine have a single row of jack screws (54) linked by a single row of connecting rods (58). The inboard die stands (11 -12) have a double row of jack screws (54) each linked by a respective double row of connecting rods (58). The double row of jack screws (54), one on the inside and one on the outside of the inboard die stand (OI1-12), ensures parallel movement of the die axle supports (24-24) and thus of the rotational transverse axle (18), thus preventing stress on the rotatable transverse axles (18) or the jack screw (54). The double row of jack screws (54) are coupled together by a chain drive mechanism (62). The inside row of jack screws (54) on the inboard die stand (I1-12) are connected by bevel gears (64) to a telescoping transmission cross shaft (66) which is then connected to the outboard jack screws (54) and connecting rods (58) by another set of bevel gears (69). The transmission cross shaft (66) is dimensioned and designed so as to make a telescopic sliding fit. The telescoping transmission cross shaft (66) is connected to a suitable drive motor (68). In this way the drive from the motor (68) is transmitted to all of the die stands (OI1-12), and causes unified movement of all the jack screws (54) in an up-down direction. The telescoping feature of the transmission shaft (66) allows for changes in the machine width.

If the gauge of the metal strip (22) is thicker, the jack screws (54) will be raised by the motor and the roller dies (28) will be shifted upward. Conversely, if the gauge is thinner, the jack screws (54) will be lowered by the motor and the roller dies (28) will be shifted downward. All die stands (OI1-12) along the length of the retrofitted roll forming machine (14) have jack screw assemblies (60) to adjust the upper die axle supports (24, 26). The jack screws (54) are adjusted using a motor (68) located in this embodiment in the center of the machine length and on the outboard side.

Horizontal Die Adjustment

Horizontal movement is only used on the more critical die stands (2, 3, 8, 9, 10, 11 and 12), along the length of the roll-forming machine (14). The more critical die stands (2, 3, 8, 9, 10, 11 and 12) are determined by the degree of the angle formed in the web material (22), that is to say die stands (OI1-12) with angles greater than about 70° are considered more critical. In this embodiment, the critical die stands are 2, 3, 8, 9, 10, 11 and 12. It should be noted that the horizontal adjustment could be added to all stations, but due to the lack of necessity at non-critical stations and economic factors, only the more critical stations (2, 3, 8, 9, 10, 11 and 12) are considered in this illustrative example.

Roller dies (28) of die stands (2, 3, 8) are moveable along the horizontal axis of the upper rotational transverse die axles (18). Diagonal corner roller dies (41) of die stands (9, 10, 11 and 12) are moveable along the horizontal axis parallel to the lower rotational transverse axis (20). This is achieved simultaneously with the up-down movement of the selected roller dies (28).

The horizontal or in-out movement of the roller dies (28) is accomplished by means of slidable bearing sleeves (50) on the outboard die stands (2, 3, 8) which are moveable horizontally within die axle supports (24, 26). As the vertical height is adjusted the horizontal displacement is adjusted by forcing the slidable bearing sleeves (50) to move along a predetermined path. This movement is slight but is sufficient to adjust the clearance necessary to achieve the proper alignment of the die (28, 30)

Horizontal movement of the roller dies (28) in outboard die stands 2, 3 and 8 achieved using a pin and groove mechanism (70) consisting of a metal pin (72) press-fit into the slidable bearing sleeve (50) of the upper die assembly. In this illustrated embodiment, the pin (72) extends from the slidable bearing sleeve (50) of outboard die stands 2, 3 and 8, through an opening in the die axle support (24, 26) and into an angled groove (74) of a metal block (76) which is secured by bolts (78) to the die stands (24, 26).

At die stands 9, 10, 11 and 12 (in this illustration), the upper rotational transverse die axles (18) have been removed form the existing machine and replaced with alternating diagonal corner rollers (41). The diagonal corner rollers (41) are connected by bevel gears (43) to the end of a die shaft (45). Die shaft (45) is mounted within bearing sleeve (65), which is within slidable block (55). Slidable block (55) is an inverted U-shaped metal block (55), housing drive gears (63) within the "U" opening (65). Slidable block (55) has T-shaped slide rails (not shown) that fit within receiving T-shaped slides (not shown), and enable block (55) to slide horizontally. Extending through the slidable block (55) is a bearing sleeve (65) on either side of U opening (67). Upper rotatable transverse axle (18) is mounted within bearing sleeve (65).

Utilization of diagonal corner rollers (41) enables the roll forming machine to press the final bends or angles in web material (22) in cases where a previous bend prevents the use of a regular angle roller die (28). For example a "C" shaped metal strip would have the first bends in the web material (22) interfere with precise forming of the second bend on either side of the "C".

Figure 8:
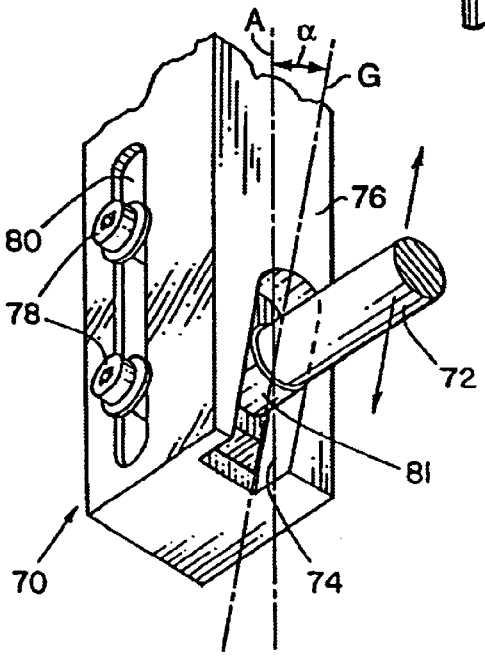
FIG. 8 is an enlarged perspective of the pin and groove mechanism in greater detail.
Figure 9:
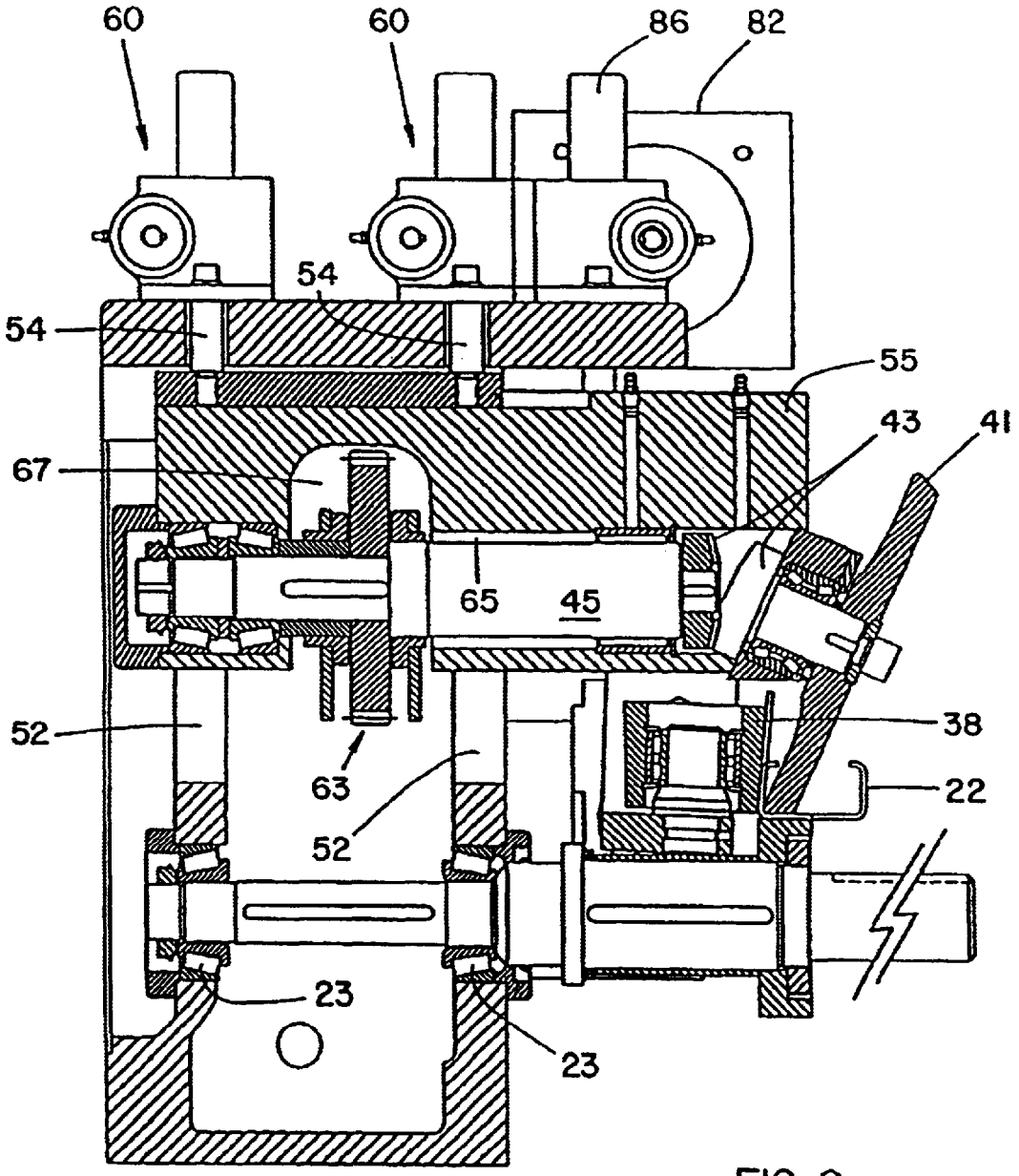
FIG. 9 is a cross-section along line 9—9 of FIG. 2 of an inboard die stand with a diagonal roller die.
Figure 10:
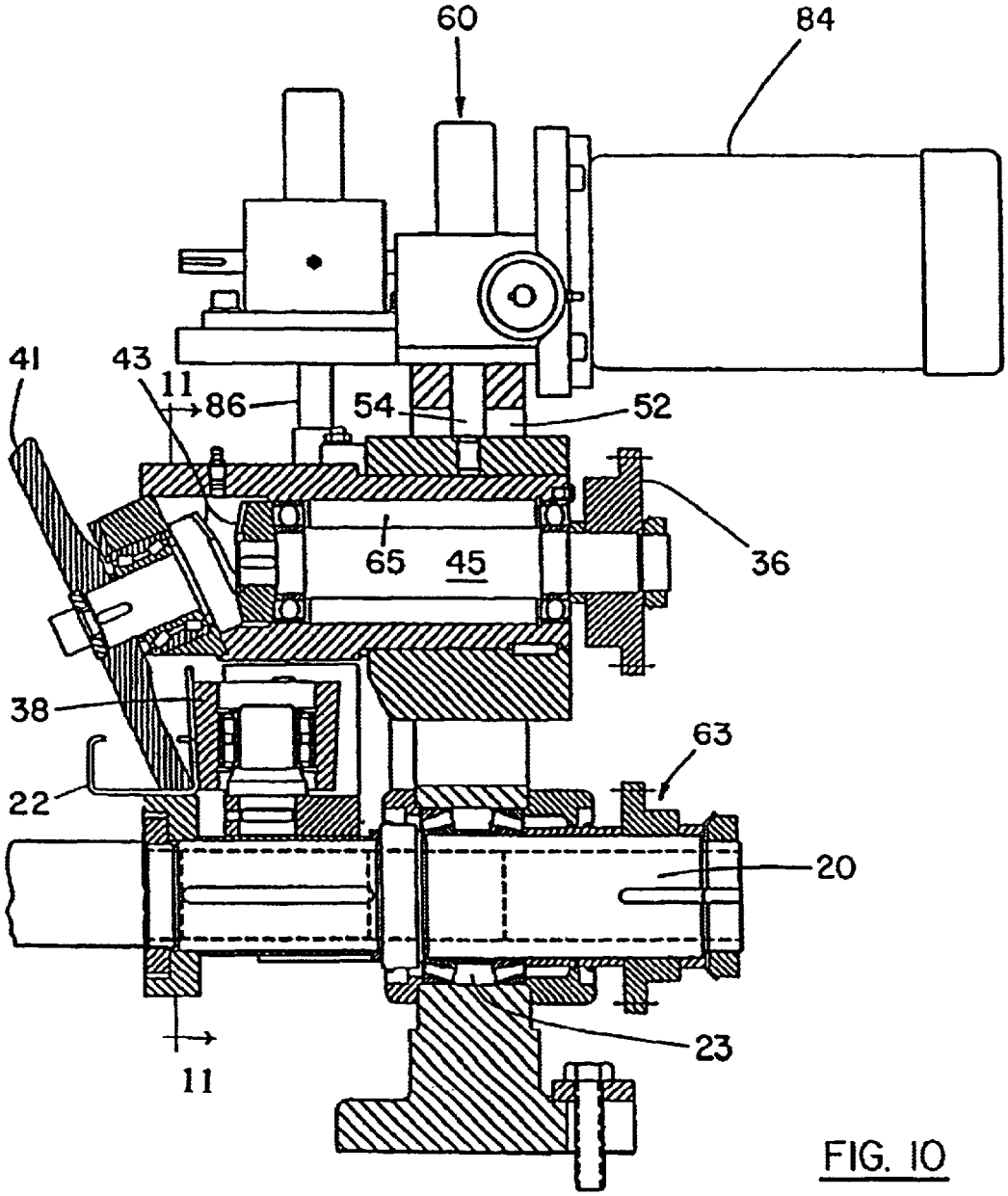
FIG. 10 is a cross-section along line 10—10 of FIG. 1 of an outboard die stand with a diagonal roller die.
Figure 11:
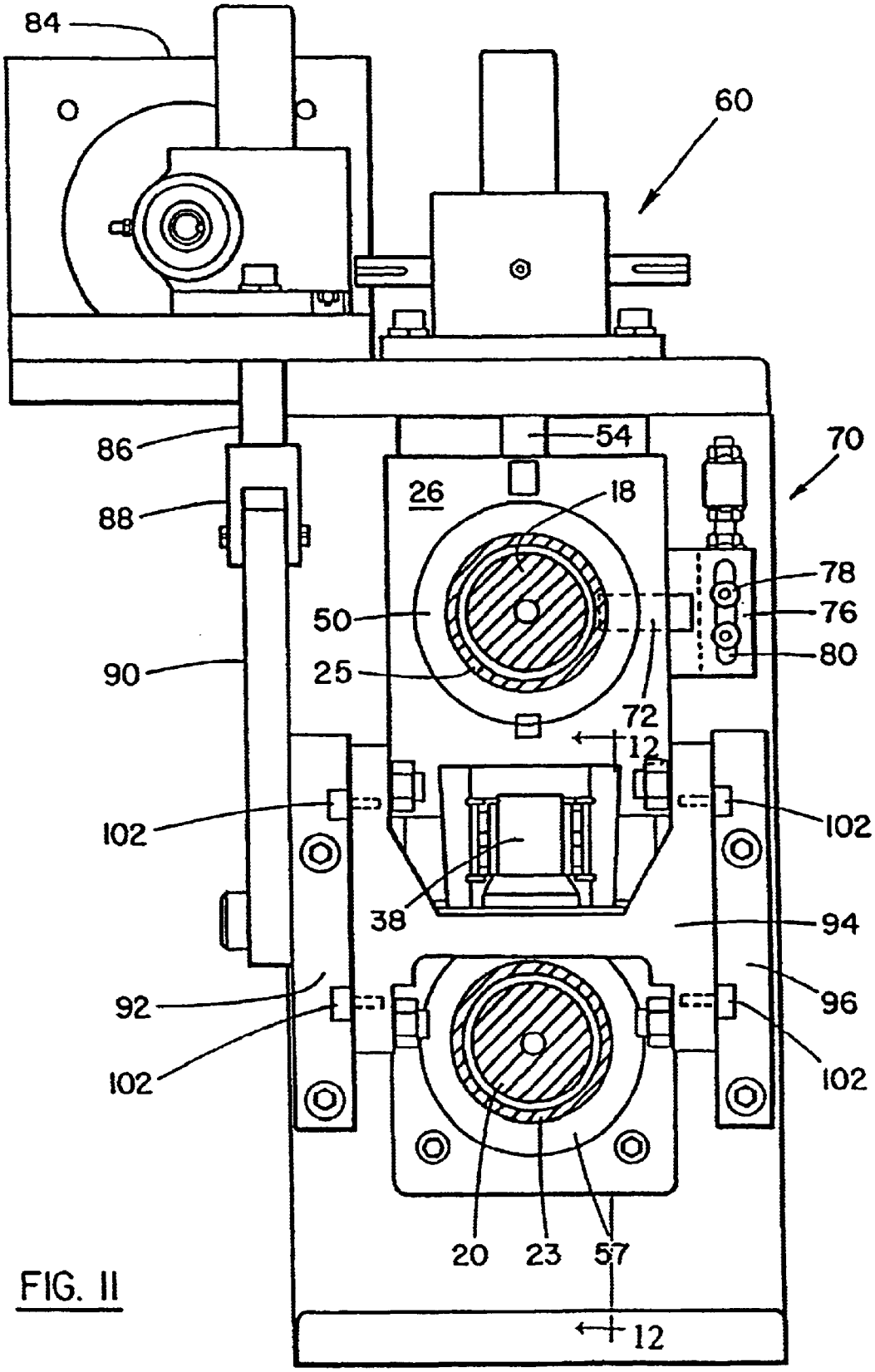
FIG. 11 is a front elevation view of a die stand partially sectioned along line 11—11 of FIG. 10 with dies removed and having a pivoting side roller.
Figure 12:
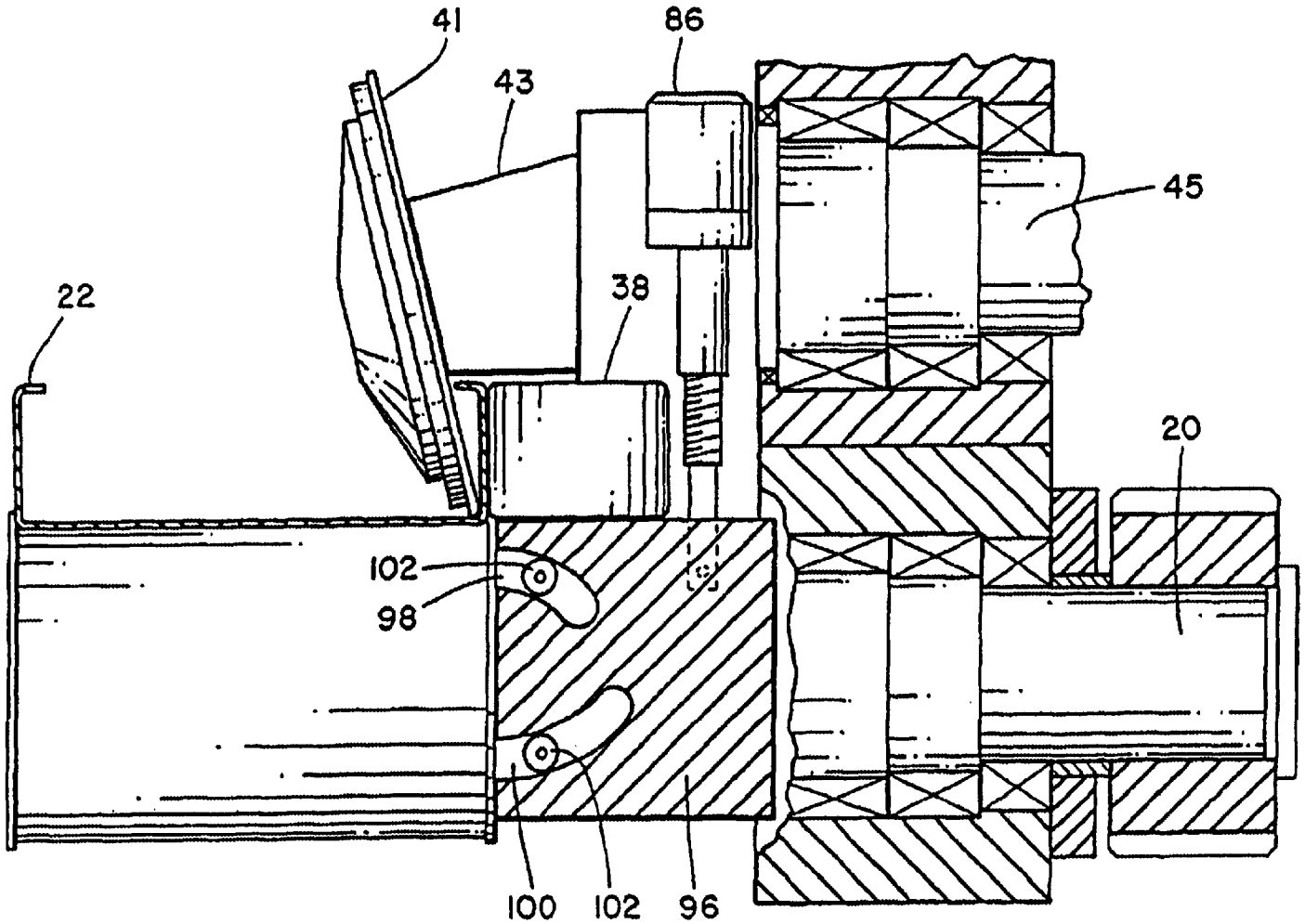
FIG. 12 is a cross-sectional side view along line 12—12 of FIG. 11 showing a die stand having a pivoting side roller.
Figure 13:
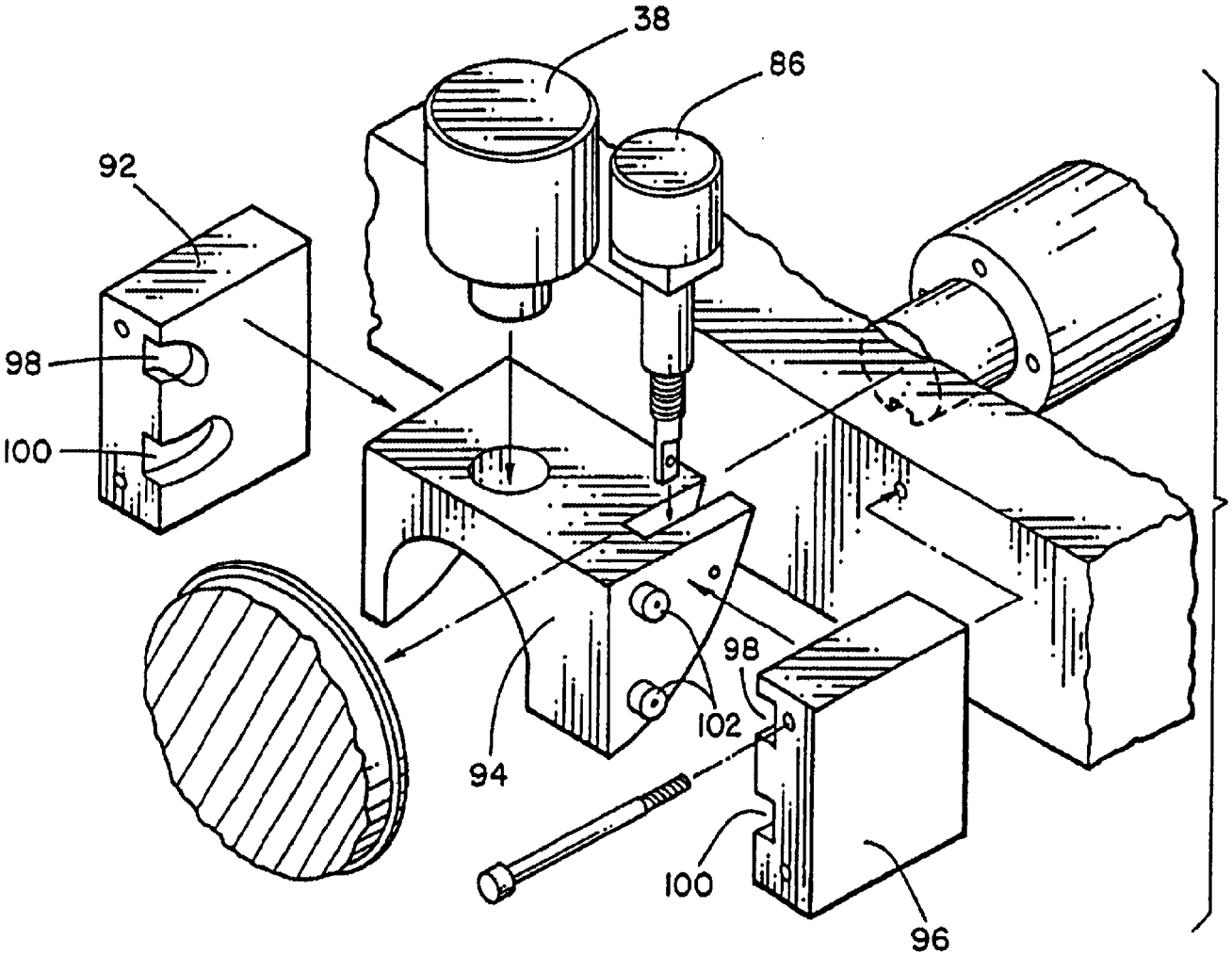
FIG. 13 is and exploded view of the pivoting side roller showing the cam rollers and groove blocks.
Figure 14:
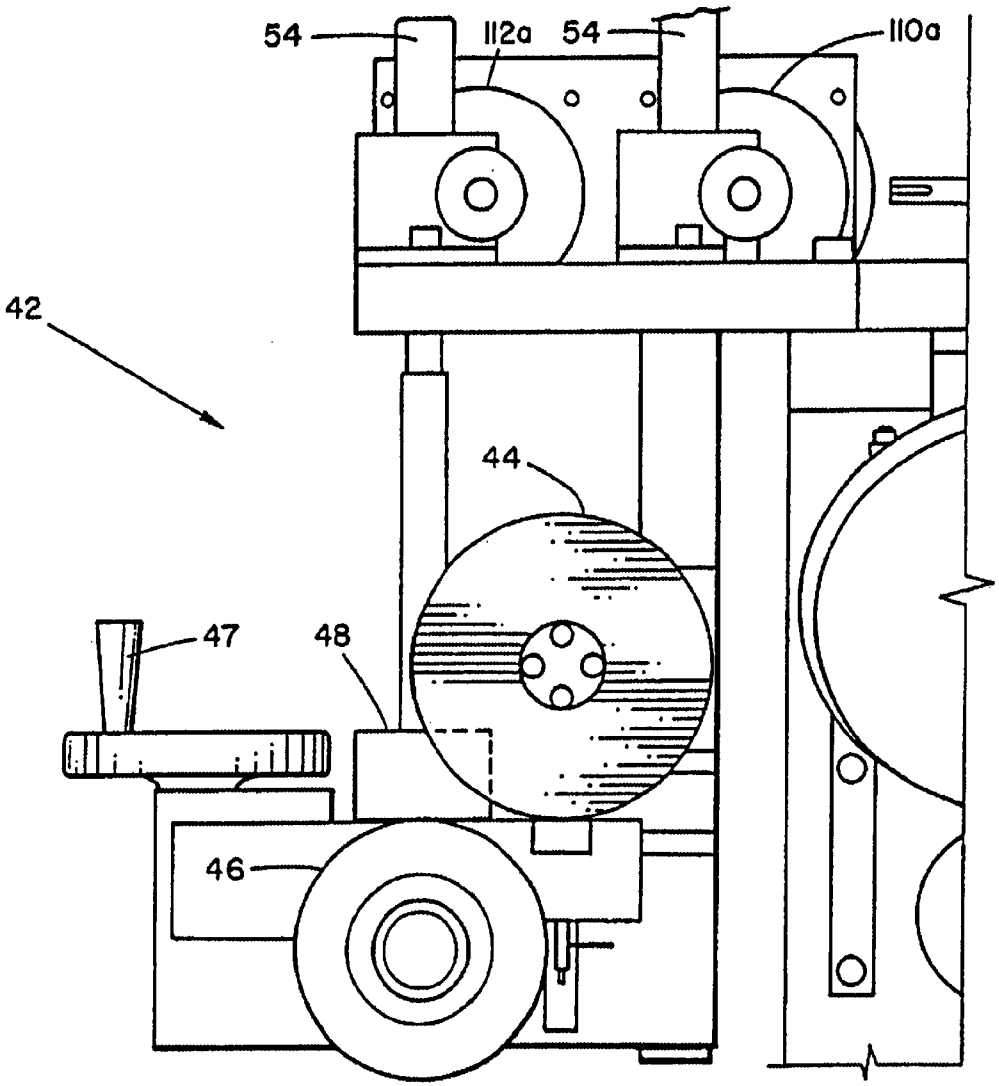
FIG. 14 is a side view of a warp straightening apparatus.

The metal block (76) is machined with a generally diagonal groove (74), shown in FIG. 8, which receives the end of the slide pin (72). Movement of the die axle supports (24, 26) vertically causes relative movement between pin (72) and block (76). This will cause the pin (72) to slide along the angular groove (74) of the metal block (76). In the case of outboard die stands (2, 3 and 8), movement of pin (72) forces the slidable bearing sleeve (50) to move horizontally in-or-out, which causes a slight transverse adjustment of the roller dies (28–28). In the case of the inboard die stands 2, 3, 8, 10 and 12, and outboard 9 and 11, the pin (72) is press-fit into the slidable block (55). Movement of pin (72) forces the slidable block (55) to move horizontally, causing a slight transverse adjustment of the roller dies (28—28). The combination of vertical and transverse movement produces an adjustment along an axis diagonal to the rotatable transverse axis.

The actual degree of movement is slight, but it is sufficient to produce the adjustment in die clearance required to accommodate variations in the web thickness.

Figure 6:
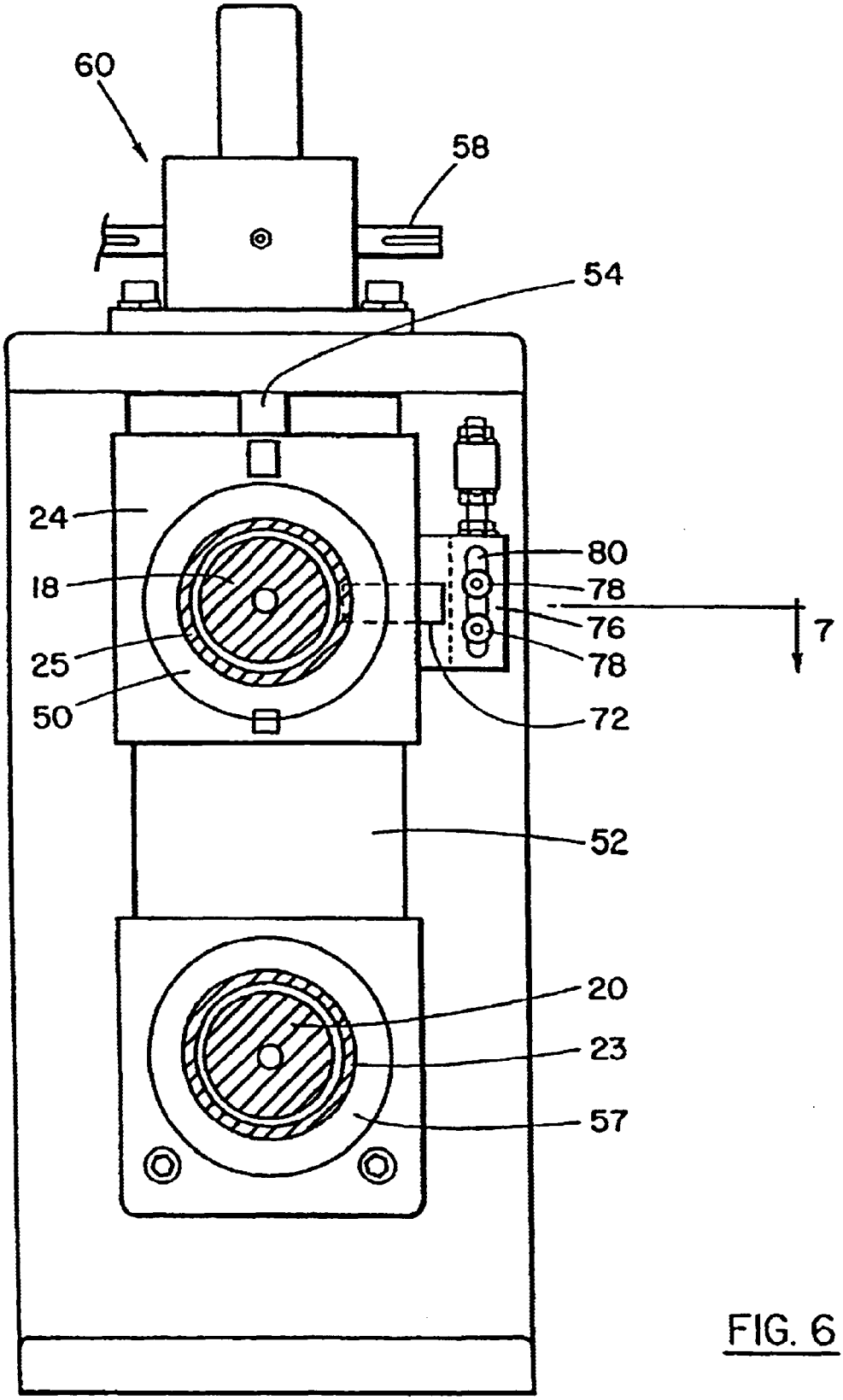
FIG. 6 is a front elevation view of a die stand with roller dies removed.
Figure 7:
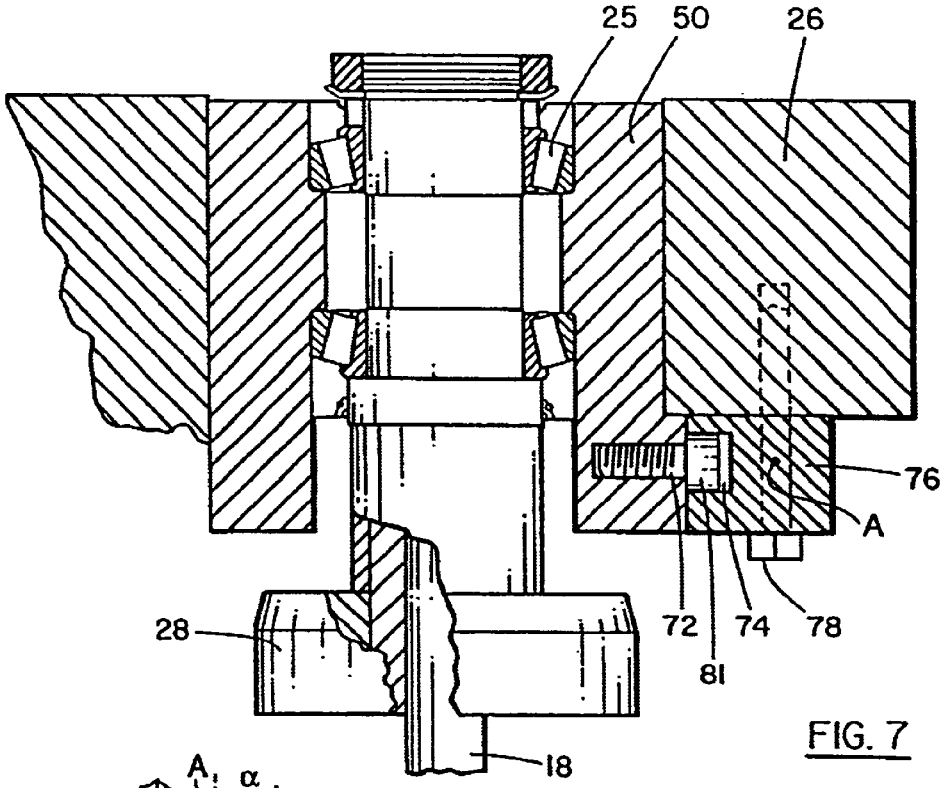
FIG. 7 is a downward cross-sectional view along line 7—7 of FIG. 6 of the upper die axle showing the moveable bearing sleeve and the pin and groove mechanism.

Referring to FIGS. 6–8 collectively, it will be readily appreciated that the bolts (78) of the pin and groove assembly (70) can be loosened, and the metal block (76) can be adjusted by sliding along the slots (80) relative to the bolts (78) to the desired location and then be re-tightened into place. This enables the metal block (76) to be adjusted to maintain the proper position of the angled groove (74) in relation to wear of the pin (72) and in cases of retooling of the roller dies (28, 30). The metal groove and pin assembly (70) is set up prior to operation to the minimum clearance on the center line. That is to say the block (76) is set at the position which holds the roller dies (28, 30) at their lowest vertical and horizontal setting.

The groove (74) of the metal block (76) runs as illustrated in FIG. 8 with the angled portion at the bottom and the plateau or straight plane of the block (76) at the top. This arrangement allows roller dies (28, 30) to move horizontally as the jack screws (54) raise the die axle supports (24, 26) upward. The angle plateaus at the region where angular movement is no longer necessary for roller die (28, 30) clearance at a particular web gauge. Therefore the pin and groove assembly (70) is added to the older machines as part of the retro-fit, in a set position that only needs adjustment for new horizontal and vertical parameters in the event of retooling or machining of the roller dies (28, 30).

In general terms, the angular shift of the roller dies (28, 30) is determined by the degree of the angular groove (74) in the metal block (76). That is, an orientation angle ox, as defined by the longitudinal axis G of the angular groove 74 in relation to the longitudinal axis A of the block 76, determines the degree of angular movement of the roller dies as they are moved in conjunction with the actuation of the jack screws 54.

Moreover, it has been discovered that the efficiency of the roll forming mill as a whole can be significantly increased by matching the orientation angle a to the formation angle of each particular die stand. For example, if the angle to be formed on the web at a particular die stand is 69° C., then the orientation angle a, that is, the inclination angle of the angular groove 74, should also be set at 69° C.

It is therefore an important aspect of the present invention that instead of forming the orientation angle a to be a uniform angle in each of the blocks 76 utilized throughout the entire roll forming mill, the orientation angle a should match the formation angle at each of the respective die stand locations along the length of the roll forming mill.

In a further embodiment of the pin and groove assembly (70) the pin could be substituted by a pin with a cam roller (81) (FIG. 8) which would reduce the frictional wear on the block (76) and pin (72), but for economic reasons, and since the actual frictional wear is minimal, a pin (72) is the preferred embodiment.

Horizontal movement of the roller dies (28) in inboard and outboard die stands (2, 3 and 8) necessitate a slight reduction in the horizontal width between the inboard and outboard die stands (2, 3, 8). For this reason the upper and lower rotational transverse die axis (18, 20) at these stations are telescoping axis (19, 21). The telescoping shaft (15) slides within the telescoping sleeve (17) to accommodate for changes in the horizontal width due to adjustment of the roller dies (28—28) or adjustment of the width of the roll forming machine (14) to accommodate work pieces of different widths Diagonal Inside Corner Roller Dies, Pivoting and Non-pivoting Side Roll Assemblies Diagonal inside corner rollers (41) are found on the final die stands (9–12 in this illustration) in a staggered formation. That is to say there is one diagonal corner roller die (41) mounted in each pair of die stands (9–12). The diagonal rollers (41) are staggered to allow formation of narrow metal strips (22) without interference from the opposite die. The diagonal rollers (41) are mounted as described in the previous section describing horizontal movement.

In the course of retrofitting older roll-forming machines (14) side angle forcing threaded elevating screw and nut systems (not shown) were removed to allow addition of technologically up-dated non-pivoting or pivoting side roll assemblies (38, 40). Non-pivoting side rollers (38) are used at the less critical die stands (8, 9, 10 in this illustration) and pivoting side rollers (40) are used at die stands (11, 12) where the angle of formation is greater than about 70° C. or more critical. The new side roll assemblies (38, 40) are added to the final five passes of the machine (as illustrated in-this embodiment), since this area of the process requires additional guidance. That is to say, in the process of forming metal strips, in this area of the machine, the side wall will have reached an angle great enough to necessitate the side rollers (38, 40). The side rollers (38, 40) are added to both the inboard and outboard die stands 9, 10, 11, and 12 (in this embodiment). All of the side rollers (38, 40) are adjusted during the initial setup, to horizontal positions at each station according to the angle at that station. These factors determine the positions and are well known to someone experienced in the art.

One embodiment of the up-dated technology of this retro-fit enables the operator to adjust the position of the side roller (38, 40) using a computer (C). The side rollers (38, 40) may be connected to suitable movement means and to the computer (C). The operator must simply enter a code into the data base for the desired movement and the computer (C) signals the movement means of the side roller (38, 40) prior to operation. While all of the side rollers (38, 40) are stationary, the final two passes at die stands 11 and 12, in this embodiment, have angular or pivotal movement. It is at these last two passes that the angle formed in the strip sheet metal is forced past it final resting state to ensure that the required angle is obtained after spring-back occurs. In this embodiment there are two pivoting side rollers (40), one located on the outboard die stand (11) at one station and one on the inboard die stand (12) at next station of the machine. They are arranged in this manner so as to work in conjunction with the diagonal corner roller dies (41). The diagonal corner roller dies (41) are alternated to allow for clearance while forming narrow metal strips.

In this embodiment each of the pivoting side rollers (38) are supplied with their own motor (82, 84) to enable independent movement and adjustment of each side. This is necessary to accommodate metal strips with differing angles or side wall heights. The movement means consist of a side roller jack screw (86) secured to a generally inverted U-shaped yoke (88), which is pivotally mounted on an axle (90). The axle (90) is pinned to a grooved plate (92) and extends into an H-shaped block (94) which carries the side roller (38). A second groove plate (96) is attached on the opposing side of the H-block (94). Both groove plates (92, 96) have an upper arcuate groove (98) and a lower arcuate groove (100). Cam rollers (102) that have been secured to the H-block (94) ride in the grooves of the groove plates (92, 96).

Operation of the motor (82, 84) will thus cause the one end of the yoke (88) to either move upwardly or downwardly, causing the axle (90) to move the side groove plates (92, 96) upward or downward. Movement of the groove plates (92, 96) force the cam rollers (102) to follow the arcuate grooves (98, 100), thus causing the H-block (94) to tilt vertically in or out, thereby tilting the pivoting side roller (38) to the desired angle for any particular job.

As mentioned the side rollers (38, 40) are set at the beginning of a job using codes and expertise on the part of the operator. It should be noted that sensors could be used at this stage to allow for automatic adjustment of the angle during operation. Due to cost factors, it is not deemed an essential part since the pivoting side roller (38) rarely require adjustment after the initial setup.

Adjustment for Web Width

At times, simple adjustment of the dies (28, 30, 41) may not be enough to accommodate the width of a particular piece of web material (22). In such cases it is desirable to be able to make large adjustments in the width of the machine. In accordance with this invention the apparatus also incorporates means for moving the inboard and outboard die stands (1–12) transversely relative to one another. This comprises the use of sub-bases (104) and sliding rails (105, 107) for moving all of the die stands (OI1-12) transversely relative to each other, so as to accommodate strips of web material of different widths. Sub-base (104) is mounted on sub-base slide rails (105) and enables the entire apparatus to slide in or out to the desired width for any particular job. In this illustration, the die stands (OI4-12) are mounted to a-base (16), mounted directly to the sub-base (104), therefore movement of base (16) and the die stands (OI4-12) is directly related to the movement of the sub-base (104). In this illustration, die stands (OIl-3) are mounted to a split-base (106), which is mounted via slide rails (107) to sub-base (104). This arrangement enables independent movement of these stations to accommodate wider web material (22). This is desirable for forming web material (22) into various forms such as "C's" . The first two edge bends of the "C" requires the machine to have a width to accommodate the full width of the web material (22). After the first two edge bends of the "C" are complete, the machine need only be as wide as the dimensions for the second side wall bends of the "C". That is to say, for example, if the original web material (22) is 6" wide and the first bend occurs at a ½" from the outside edge on both sides of the web material (22), the machine would have to be set at the 6" width to accommodate the web material (22) prior to the edge bends. After the first edge bends, the machine would only have to be at a 5" width to accommodate the half-formed "C" strip, and form the second side wall bends at say 1½" from the first edge bends.

This separate width adjustment feature allows the flexibility to form web material (22) of many different dimensions.

This width adjustment may or may not be existing on the retro-fit machine (14). In the case that it is existing it may or may not be motorized. In either case a suitable motor (108) that is compatible with the retro-fit will be used. In the case that the machine to be retrofitted does not have the manual vertical adjustment existing, the appropriate parts can be added and are well known in the art.

Warp Adjustment

The final stage of the retro-fit is located at the exit (X) of the roll-forming machine (14). (see figure.)

It is well known that when forming metal'sections, they may have a tendency to warp, which implies either that the section will bend upwardly or downwardly, or sideways, or twist.

In order to overcome this tendency, there is provided a warp straightening assembly (42) which is located just downstream, at the exit (E) of the apparatus. The warp straightening assembly (42) comprises a moveable lower straightening roller (46), which is moveable along a Y-axis or vertically, and is located along the pass line of the lowermost web of the metal section. There is a moveable upper straightening roller (44), also moveable vertically and passes along the top side of the formed web material (22). Lower and upper straightening rolls (46, 44) are offset along the horizontal axis, so that the formed web material (22) can be pushed up or down to correct the warp. Both straightening rollers (46, 44) are operated by individual motors (l10*ab*, 112*ab*), and both the inboard (I) and outboard (O) sides of the roll former (14) have a warp control assembly (42).

In this illustration the upper straightening roll (44) is operated by the motors 110*a* for the inboard and motor 110*b* for the outboard straightening roll (44). The inboard and outboard lower straightening rolls (46) are operated by motors 112*a* and 112*b* respectively. There are a total four motors (110*a*, 110*b*, 112*a*, 112*b*) are used to operate this section. Each straightening roller (46, 44) is adjusted independent of the other and may be controlled by the computer (C) using a sensor (S). The warp control assembly (42) also has a straightening side roller (48) that adjusts for in-out warping of the finished metal strips (22). The straightening side roller (48), in this embodiment is controlled by the operator using a manual crank arm (47) and utilizing movement means similar to those used for the adjustment of pivoting side roller (38) (i.e. groove plate (92, 96) and cam rollers (102)). The operator visually observes the warp as the finished piece moves along the line and turns the crank arm (47) accordingly to compensate and correct the warp. It should be noted that a motor and a sensor could be used at this step as an option, but for economic reasons the manual crank (47) is the preferred embodiment.

As in the case of preceding rolls, the straightening rolls (46, 44) are mounted as left and right hand sets of rolls on opposite sides of the apparatus and will move towards and away from one another in conjunction with and in unison with the movement towards and away from one another and all of the rest of the roller dies in the manner described above.

It will of course be appreciated that in the event of a changeover in the operation of the roll forming apparatus from one web to another, the web may have a thickness which is increased or decreased somewhat as compared with the previous web that was being processed. These adjustments can, in the great majority of cases, be taken into account simply by programming the computer (C), so that it instructs the motors (32) to adjust the die clearance to suit the new web thickness. The method of operation of the retro-fit roll former is believed to be selfvident from the foregoing.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A rolling mill apparatus for forming a web of material, comprising:

a die stand including an upper die assembly and a lower die assembly, said die stand bending said web to a predetermined formation angle as said web passes between said upper die assembly and said lower die assembly;

a movement means for selectively moving said upper die assembly in a vertical direction, thereby adjusting a vertical clearance between said upper die assembly and said lower die assembly;

a pin fixed to said upper die assembly;

a cam block having an angled groove formed therein at a predetermined orientation angle, said pin travelling in said angled groove when said upper die assembly is moved in said vertical direction thereby causing said upper die assembly to move horizontally, wherein the combination of said vertical and said horizontal movement produces a diagonal movement of said upper die assembly in relation to said lower die assembly; and wherein said predetermined orientation angle of said block is approximately equal to said predetermined formation angle.

2. The rolling mill apparatus for forming a web of material as claimed in claim 1, further comprising:

pairs of matching die stands arranged on either longitudinal side of said web to engage said web at spaced apart locations along said web's length; and wherein each of said die stands of said pairs of said matching dies stands includes said movement means, said pin and said cam block with said angled groove in operative association with each of said die stands.

3. The rolling mill apparatus for forming a web of material as claimed in claim 2, further comprising:

a first actuating means connecting all of said movement means oriented along a first longitudinal side of said web, and a second actuating means connecting all of said movement means oriented along a second longitudinal side of said web; and a transmission means connecting said first and second actuating means so as to simultaneously operate all of said movement means on either longitudinal side of said web.

4. The rolling mill apparatus for forming a web of material as claimed in claim 1, wherein:

said movement means comprises a threaded screw attached to said upper die assembly wherein rotation of said threaded screw causes said vertical movement of said upper die assembly.

5. The rolling mill apparatus for forming a web of material as claimed in claim 3, wherein:

each of said movement means comprise a threaded screw attached to said upper die assembly wherein rotation of said threaded screw causes said vertical movement of said upper die assembly;

said first actuating means comprise a plurality of first connecting rods connecting all of said threaded screws on said first longitudinal side of said web and said second actuating means comprise a plurality of second connecting rods connecting all of said threaded screws on said second longitudinal side of said web; and said transmission means comprises a power operated telescoping cross shaft.

6. The rolling mill apparatus for forming a web of material as claimed in claim 5, wherein:

said power operated telescoping cross shaft comprises a motor for driving all of said threaded screws on said first and said second longitudinal sides of said web simultaneously and in unison.

7. The rolling mill apparatus for forming a web of material as claimed in claim 1, further comprising:

a straightening roll assembly for engaging said web after said web exits from said die stand to correct warping of said web material.

8. The rolling mill apparatus for forming a web of material as claimed in claim 7, wherein:

said straightening roll assembly includes upper and lower rolls which are out of registration with one another, said upper and lower dies being moveable relative to each other; and wherein said upper rolls are moveable to apply downward pressure on said web and said lower rolls are moveable to apply upward pressure on said web.

9. The rolling mill apparatus for forming a web of material as claimed in claim 8, further comprising:

a warp straightening roll assembly for selectively contacting said web, said warp straightening roll assembly being moveable in a horizontal plane to correct for sideways warp of said web material.

10. A method of continuously forming a web of material as said web passes through a die stand including an upper die assembly and a lower die assembly, said die stand being operatively connected to a movement means, a pin fixed to said upper die assembly and a cam block having a groove formed therein, said method comprising the steps of:

bending said web to a predetermined formation angle as said web passes between said upper die assembly and said lower die assembly;

operating said movement means to selectively move said upper die assembly in a vertical direction to thereby adjust a vertical clearance between said upper die assembly and said lower die assembly;

forming said groove to be at a predetermined orientation angle to a longitudinal axis of said cam block;

orienting said pin so as to travel in said groove when said upper die assembly is moved in said vertical direction thereby causing said upper die assembly to move horizontally, wherein the combination of said vertical and said horizontal movement produces a diagonal movement of said upper die assembly in relation to said lower die assembly; and setting said predetermined orientation angle of said block to be approximately equal to said predetermined formation angle.

11. The method of continuously forming a web of material as said web passes through a die stand including an upper die assembly and a lower die assembly, said die stand being operatively connected to a movement means, a pin fixed to said upper die assembly and a cam block having a groove formed therein according to claim 10, said method further comprising the steps of:

arranging pairs of matching die stands on either longitudinal side of said web to engage said web at spaced apart locations along said web's length; and equipping each of said die stands of said pairs of said matching dies stands to include said movement means, said pin and said cam block with said groove.

12. The method of continuously forming a web of material as said web passes through a die stand including an upper die assembly and a lower die assembly, said die stand being operatively connected to a movement means, a pin fixed to said upper die assembly and a cam block having a groove formed therein according to claim 11, said method further comprising the steps of:

connecting all of said movement means oriented along a first longitudinal side of said web with a first actuating means;

connecting all of said movement means oriented along a second longitudinal side of said web with a second actuating means; and connecting said first and second actuating with a transmission means so as to simultaneously operate all of said movement means on either longitudinal side of said web.

13. The method of continuously forming a web of material as said web passes through a die stand including an upper die assembly and a lower die assembly, said die stand being operatively connected to a movement means, a pin fixed to said upper die assembly and a cam block having a groove formed therein according to claim 10, said method further comprising the steps of:

forming said movement means to include a threaded screw attached to said upper die assembly wherein rotation of said threaded screw causes said vertical movement of said upper die assembly.

14. The method of continuously forming a web of material as said web passes through a die stand including an upper die assembly and a lower die assembly, said die stand being operatively connected to a movement means, a pin fixed to said upper die assembly and a cam block having a groove formed therein according to claim 12, said method further comprising the steps of:

forming each of said movement means to include a threaded screw attached to said upper die assembly wherein rotation of said threaded screw causes said vertical movement of said upper die assembly;

forming said first actuating means to include a plurality of first connecting rods connecting all of said threaded screws on said first longitudinal side of said web and said second actuating means comprise a plurality of second connecting rods connecting all of said threaded screws on said second longitudinal side of said web; and forming said transmission means to include a power operated telescoping cross shaft.

15. The method of continuously forming a web of material as said web passes through a die stand including an upper die assembly and a lower die assembly, said die stand being operatively connected to a movement means, a pin fixed to said upper die assembly and a cam block having a groove formed therein according to claim 14, said method further comprising the steps of:

forming said power operated telescoping cross shaft to include a motor for driving all of said threaded screws on said first and said second longitudinal sides of said web simultaneously and in unison.

16. The method of continuously forming a web of material as said web passes through a die stand including an upper die assembly and a lower die assembly, said die stand being operatively connected to a movement means, a pin fixed to said upper die assembly and a cam block having a groove formed therein according to claim 10, said method further comprising the steps of:

utilizing a straightening roll assembly for engaging said web after said web exits from said die stand to correct warping of said web material.

17. The method of continuously forming a web of material as said web passes through a die stand including an upper die assembly and a lower die assembly, said die stand being operatively connected to a movement means, a pin fixed to said upper die assembly and a cam block having a groove formed therein according to claim 16, said method further comprising the steps of:

forming said straightening roll assembly to include upper and lower rolls which are out of registration with one another, said upper and lower dies being moveable relative to each other;

selectively moving said upper rolls to apply downward pressure on said web when said web is warped in an upwards direction; and selectively moving said lower rolls to apply upward pressure on said web when said web is warped in an upwards direction.

18. The method of continuously forming a web of material as said web passes through a die stand including an upper die assembly and a lower die assembly, said die stand being operatively connected to a movement means, a pin fixed to said upper die assembly and a cam block having a groove formed therein according to claim 17, said method further comprising the steps of:

utilizing a warp straightening roll assembly for selectively contacting said web, said warp straightening roll assembly being moveable in a horizontal plane to correct for sideways warp of said web material.

* * * * *